US006548748B2

(12) United States Patent
Ishida et al.

(10) Patent No.: US 6,548,748 B2
(45) Date of Patent: Apr. 15, 2003

(54) ELECTRONIC MUSICAL INSTRUMENT WITH MUTE CONTROL

(75) Inventors: Tadayuki Ishida, Hamamatsu (JP); Hiroshi Kato, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 10/052,836

(22) Filed: Jan. 17, 2002

(65) Prior Publication Data

US 2002/0092412 A1 Jul. 18, 2002

(30) Foreign Application Priority Data

Jan. 18, 2001 (JP) ..... 2001-010558

(51) Int. Cl.[7] ..... G10N 1/18; G10N 7/00
(52) U.S. Cl. ..... 84/615; 84/653
(58) Field of Search ..... 84/615, 653, 600, 84/477 R

(56) References Cited

U.S. PATENT DOCUMENTS 5,777,251 A * 7/1998 Hotta et al. ..... 84/609
6,147,292 A * 11/2000 Ito ..... 84/615
6,245,983 B1 * 6/2001 Ishiguro ..... 84/470 R
6,274,798 B1 * 8/2001 Suzuki et al. ..... 84/477 R
6,362,410 B1 * 3/2002 Kira ..... 84/618

* cited by examiner

*Primary Examiner*—Jeffrey Donels
(74) *Attorney, Agent, or Firm*—Christie, Parker & Hale, LLP

(57) ABSTRACT

An electronic musical instrument has a tone generation instruction operation member for instructing to start tone generation, and a tone generation control unit for starting a tone generation process upon operation of the tone generation instruction operation member, continuing the tone generation process even after the tone generation instruction operation member is released, and executing a mute process when the identical tone generation instruction operation member is operated again.

7 Claims, 7 Drawing Sheets

FIG. 7

| 701 TONE COLOR NO. | 702 VELOCITY | 703 TOGGLE FLAG | 704 RELEASE TIME | 705 ATTACK TIME | 706 DECAY TIME | 707 VIBRATO RATE | 708 VIBRATO DEPTH | 709 VIBRATO DELAY | ----- |
|---|---|---|---|---|---|---|---|---|---|
| 1 | 96(60H) | 0 | 64(40H) | 64(40H) | 64(40H) | 64(40H) | 64(40H) | 64(40H) | |
| 2 | 96(60H) | 1 | 64(40H) | 64(40H) | 64(40H) | 64(40H) | 64(40H) | 64(40H) | |
| 3 | 96(60H) | 1 | 64(40H) | 64(40H) | 64(40H) | 64(40H) | 64(40H) | 64(40H) | |
| 4 | 96(60H) | 0 | 64(40H) | 64(40H) | 64(40H) | 64(40H) | 64(40H) | 64(40H) | |
| 5 | 96(60H) | 0 | 64(40H) | 64(40H) | 64(40H) | 64(40H) | 64(40H) | 64(40H) | |
| ⋮ | | | | | | | | | |
| n | 96(60H) | 1 | 64(40H) | 64(40H) | 64(40H) | 64(40H) | 64(40H) | 64(40H) | |

ELECTRONIC MUSICAL INSTRUMENT WITH MUTE CONTROL

CROSS-REFERENCE TO RELATED APPLICATIONS

This application is based upon and claims priority of Japanese Patent Application No. 2001-010558, filed on Jan. 18, 2001.

BACKGROUND OF THE INVENTION

1. Field of the Invention

The present invention relates to an electronic musical instrument and, more particularly, to an electronic musical instrument for making tone generation control in response to operation of an operation member.

2. Description of the Related Art

A tone generation operation of a conventional electronic musical instrument starts tone generation in response to an ON key event of a keyboard. For example, since a piano tone color requires a decay tone, tone generation progresses like attack→decay→sustain→release in response to an ON key event of the keyboard, and then comes to an end. Since an organ tone color requires a sustaining tone, tone generation starts in response to an ON key event of the keyboard, continues while that key is kept pressed, and stops in response to an OFF key event.

However, in the conventional method, a key must be kept pressed to sustain tone generation (sustaining tone). Hence, to keep generating only a specific tone while stopping tone generation of other tones like normal tones in response to OFF key events upon performance, a very high skill is required. For example, it is difficult to sustain tone generation of only one tone in a bass range, and to make bimanual performance in a treble range.

When tone generation is a sequence, even when adlib tones of applause, wave, bell, and roll cymbal, which require different tone durations (tone generation times) in correspondence with situations, are to be generated, since tone generation comes to an end if the sequence is complete, the user's requirement cannot be met.

For example, when the user wants to play a Christmas song while generating bell tones, if a sequence is set so that a bell tone comes to an end within several seconds, he or she must operate a bell operation member repetitively, resulting in impractical operation, and must make another operation for playing back sequence data that records bell tones using a music sequencer. However, sequencer data is used to play for a given fixed duration, and is not suitable for adlib operations that generate tones for arbitrary durations in correspondence with situations.

In the conventional method, since a tone to be generated or a sequence that allows tone generation in response to a single ON key event is determined, a required tone duration (tone generation time) cannot be obtained in correspondence with a situation. More specifically, a tone generation operation member must be kept pressed (operated) to generate a tone for a required duration.

SUMMARY OF THE INVENTION

It is an object of the present invention to provide an electronic musical instrument which can obtain desired tone duration by operating a given operation member.

According to one aspect of the present invention, there is provided an electronic musical instrument comprising a tone generation instruction operation member for instructing to start tone generation, and a tone generation control unit for starting a tone generation process upon operation of the tone generation instruction operation member, continuing the tone generation process even after the tone generation instruction operation member is released, and executing a mute process when the identical tone generation instruction operation member is operated again.

According to another aspect of the present invention, there is provided an electronic musical instrument comprising a tone generation instruction operation member for instructing to start tone generation, a tone generation mode storage unit for storing tone generation modes, and a tone generation control unit for, when the tone generation mode is a first mode, starting a tone generation process upon operation of the tone generation instruction operation member and executing a mute process upon release of the tone generation instruction operation member, and for, when the tone generation mode is a second mode, starting a tone generation process upon operation of the tone generation instruction operation member, continuing the tone generation process even after the tone generation instruction operation member is released, and executing a mute process when the identical tone generation instruction operation member is operated again.

According to the present invention, since a tone generation process is continuously done during a period from when the tone generation instruction operation member is operated until it is operated again, a desired tone duration can be obtained. Since the tone generation process can be continued even when the tone generation instruction operation member is released after operation, the player can freely use his or her hands and feet. For example, the player can make bimanual performance in a treble range while sustaining tone generation of only one tone in a bass range.

BRIEF DESCRIPTION OF THE DRAWINGS

FIG. 7 is a table showing the format of tone color data; and

DETAILED DESCRIPTION OF THE PREFERRED EMBODIMENTS

Figure 1:
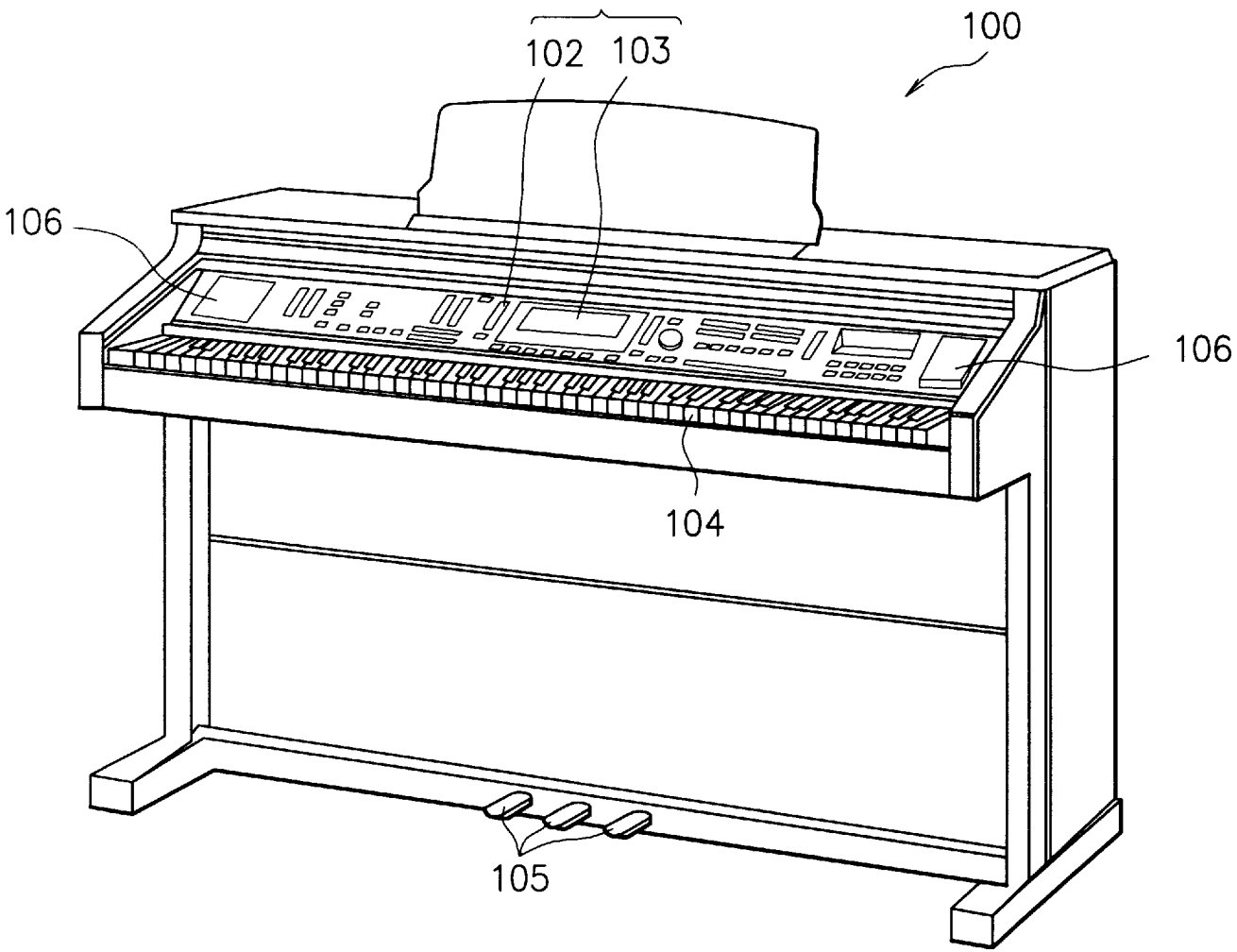
FIG. 1 is a perspective view showing the outer appearance of an electronic musical instrument according to an embodiment of the present invention.

FIG. 1 shows the outer appearance of an electronic musical instrument according to the first embodiment of the present invention. An electronic musical instrument 100 has a panel 101, keyboard 104, foot pedals 105, and loudspeakers 106. The panel 101 has panel switches (operation members) 102 and a liquid crystal display 103.

Figure 2:
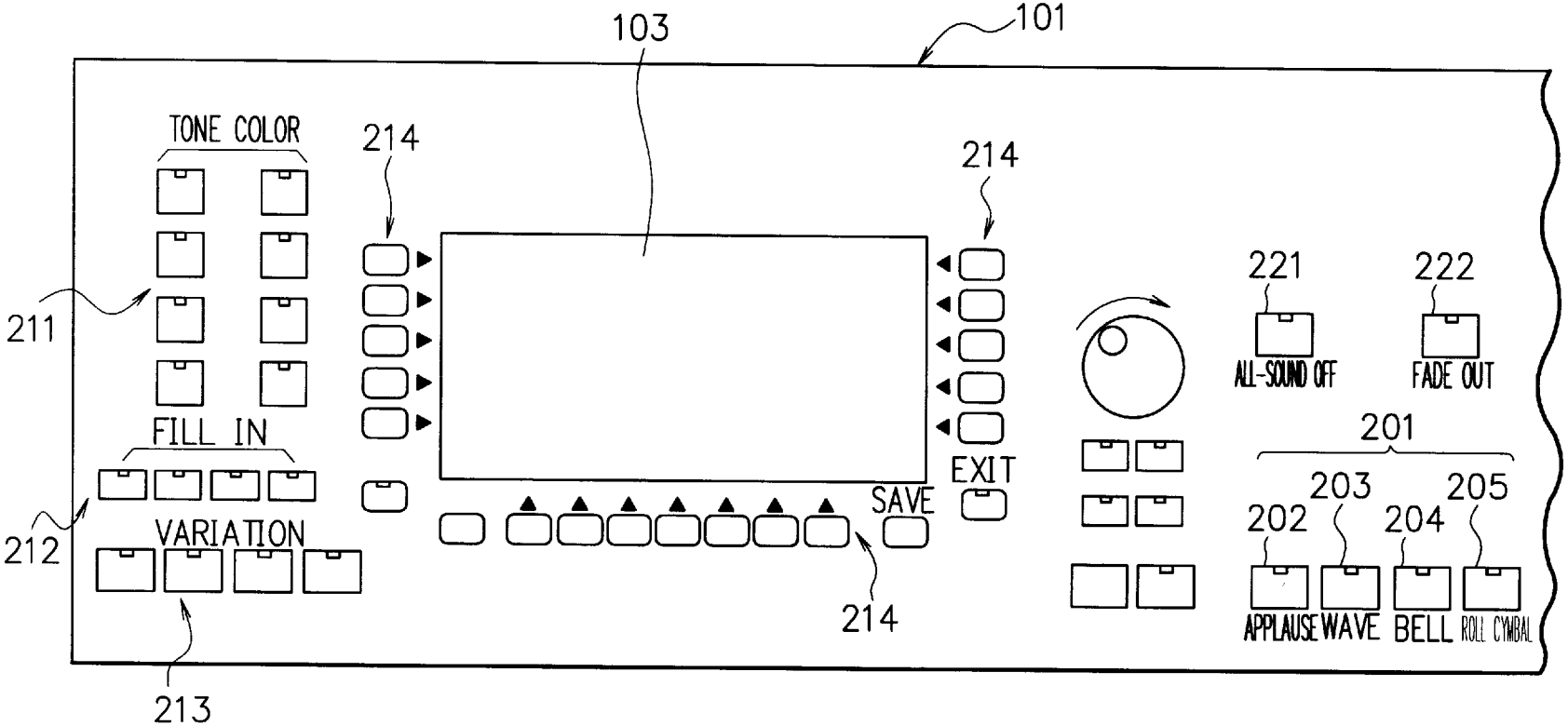
FIG. 2 is a top view showing the outer appearance of a panel.

FIG. 2 is an enlarged view showing the outer appearance of the panel 101 shown in FIG. 1. The panel 101 has tone generation instruction switches 201 in addition to the liquid crystal display 103. The tone generation instruction switches 201 include an applause switch 202, wave switch 203, bell switch 204, and roll cymbal switch 205. Upon pressing each of the switches 202 to 205, a tone with a corresponding color or timbre is generated.

In addition, the panel 101 has tone color switches 211 used to select a tone color, fill-in switches 212 used to issue a fill-in instruction, variation switches 213 used to select a variation of a tone color or the like, and switches 214 used to select display items on the liquid crystal display 103.

Figure 8A:
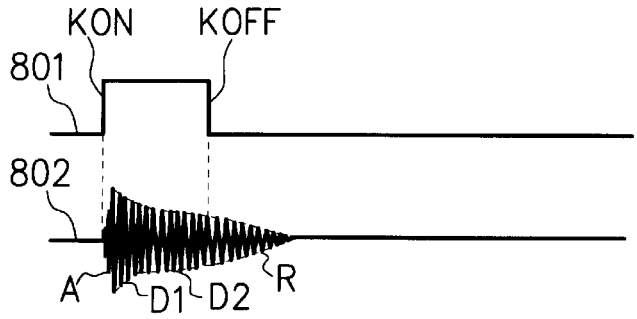
FIGS. 8A to 8D are charts showing the relationship between a tone generation instruction switch and tone signal.
Figure 8B:
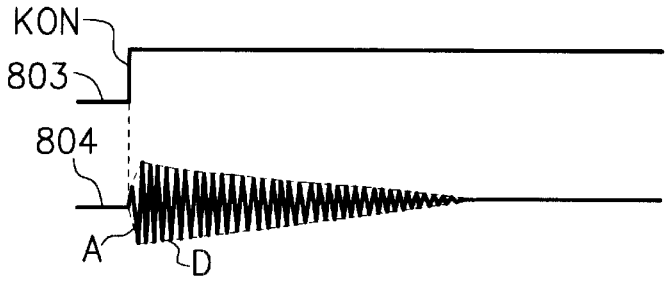
Figure 8C:
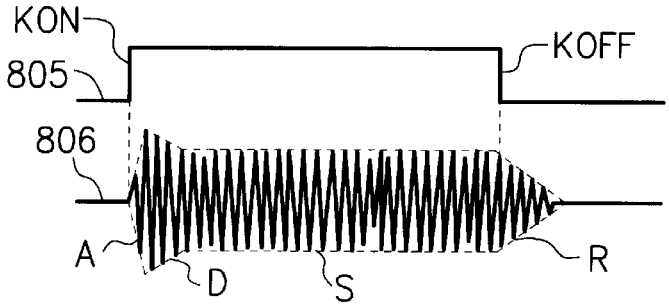
Figure 8D:
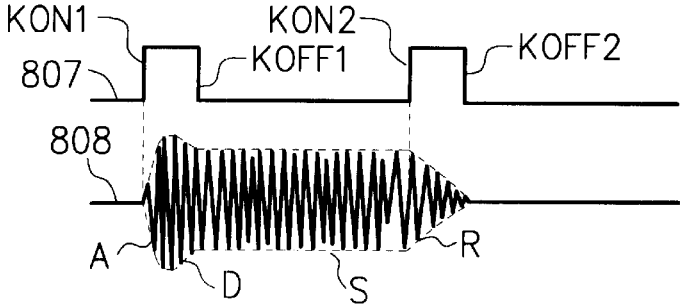

FIGS. 8A to 8C show the relationship between the tone generation instruction switches 201 (FIG. 2) and a tone generation control process in a first tone generation mode, and FIG. 8D shows that relationship in a second tone generation mode. When each tone generation instruction switch 201 is pressed, it generates a key ON signal KON. When the switch is released, it generates a key OFF signal KOFF.

In the first tone generation mode as shown in FIGS. 8A to 8C, when each tone generation instruction switch 201 is pressed to generate a key ON signal KON, a tone generation process starts. When the tone generation instruction switch 201 is released to generate a key OFF signal KOFF, a mute process is executed.

Referring to FIG. 8A, when a tone generation instruction switch signal 801 changes to key ON level KON, a tone generation process starts, and a tone signal 802 forms attack A, first decay D1, and second decay D2. When the tone generation instruction switch signal 801 changes to key OFF level KOFF, a mute process starts, and the tone signal 802 forms release R.

Referring to FIG. 8B, when a tone generation instruction switch signal 803 changes to key ON level KON, a tone generation process starts, and a tone signal 804 forms attack A and decay D. Since this tone signal 804 generates a decay tone, the generated tone is muted before the tone generation instruction switch signal 803 changes to key OFF level KOFF.

Referring to FIG. 8C, when a tone generation instruction switch signal 805 changes to key ON level KON, a tone generation process starts, and a tone signal 806 forms attack A, decay D, and sustain S. Sustain S continues tone generation by repetitively reading out a given tone waveform in a waveform memory. After that, when the tone generation instruction switch signal 805 changes to key OFF level KOFF, a mute process is executed, and the tone signal 805 forms release R.

In the second tone generation mode, as shown in FIG. 8D, a tone generation process starts in response to an ON event of each tone generation instruction switch 201, and continues the tone generation process after the tone generation instruction switch 201 is released. When the tone generation instruction switch 201 is pressed again, a mute process is executed.

More specifically, when a tone generation instruction switch signal 807 changes to key ON level KON1, a tone generation process starts, and a tone signal 808 forms attack A, decay D, and sustain S independently of subsequent key OFF level KOFF1. Sustain S continues tone generation by repetitively reading out a given tone waveform in a waveform memory. After that, when the tone generation instruction switch signal 807 changes to key ON level KON2 again, a mute process is executed independently of subsequent key OFF level KOFF2, and the tone signal 808 forms release R.

An all-sound OFF switch 221 and fade-out switch 222 in FIG. 2 will be described below. When the tone generation mode is the second mode, a tone generation process starts in response to the first key ON event of a given tone generation instruction switch 201, and a mute process is executed in response to the next key ON event of that tone generation instruction switch 201. However, when a plurality of tones such as applause tone, wave tone, bell tone, and the like simultaneously sound, and are to be muted at the same time, it is difficult to stop these tones by simultaneously operating all the tone generation instruction switches 201.

In such case, the all-sound OFF switch 221 is used. Upon operating (pressing) this all-sound OFF switch 221, all tones (including keyboard tones) whose tone generation process is underway are stopped at the same time.

The panel has the fade-out switch 222 in addition to the all-sound OFF switch 221. Upon operating (pressing) this fade-out switch 222, all tones (including keyboard tones) whose tone generation process is underway can fade out at the same time.

Figure 3:
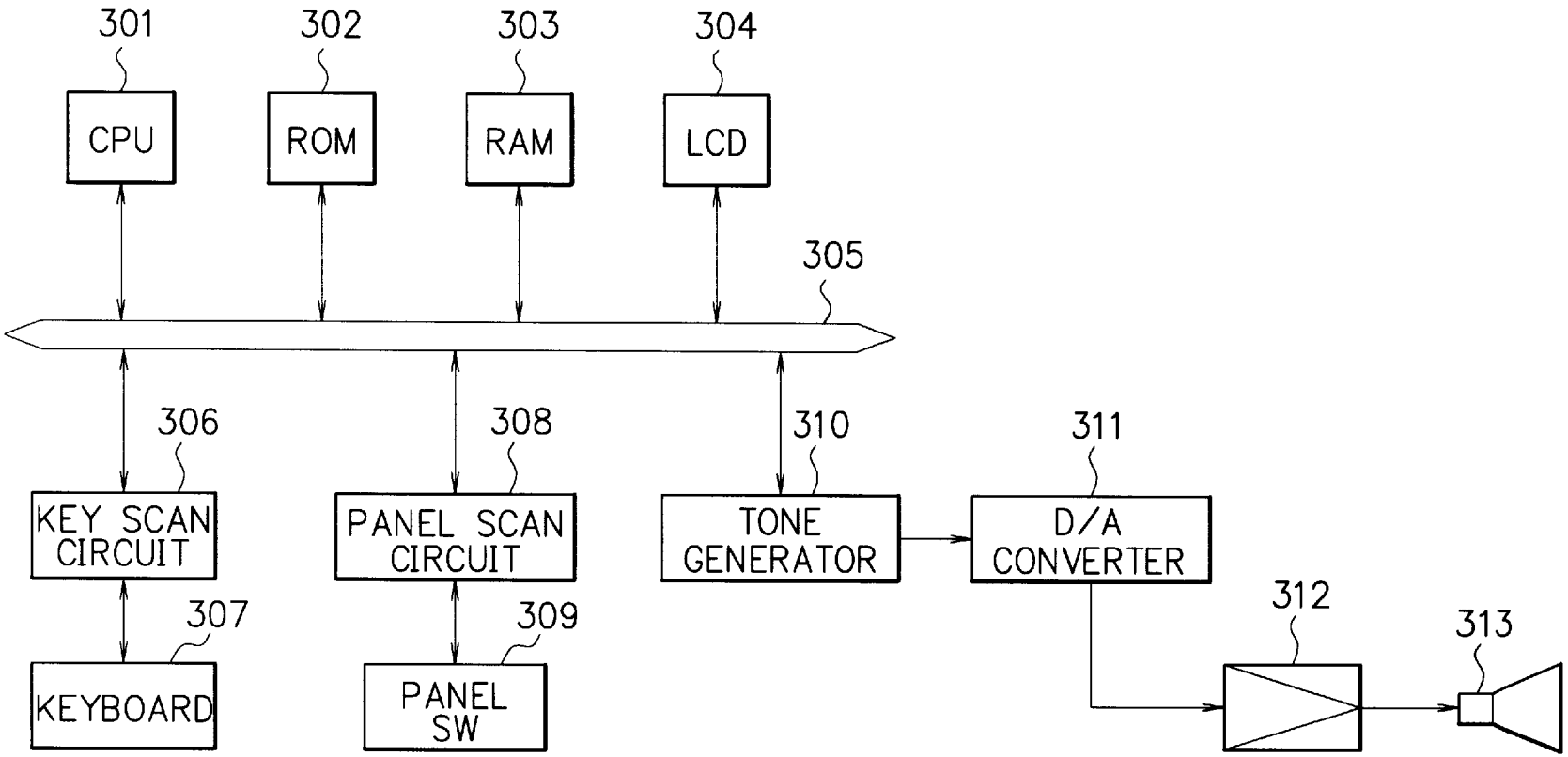
FIG. 3 is a block diagram showing the hardware arrangement of the electronic musical instrument.

FIG. 3 is a block diagram showing the hardware arrangement of the electronic musical instrument 100 shown in FIG. 1. A CPU 301, ROM 302, RAM 303, liquid crystal display (LCD) 304, key scan circuit 306, panel scan circuit 308, and tone generator 310 are connected to a bus 305.

A keyboard 307 has a plurality of black and white keys. The key scan circuit 306 outputs key ON or OFF information to the CPU 301 in response to an key ON or OFF event on the keyboard 307. Panel switches 309 include the tone generation instruction switches 201 (FIG. 2) and the like. The panel scan circuit 308 outputs operation information (key ON signal KON or key OFF signal KOFF) to the CPU 301 in response to operation of each panel switch 309. The liquid crystal display 304 displays given functions and the like.

The tone generator 310 generates a tone signal based on tone parameters received from the CPU 301, and outputs the tone signal to a D/A converter 311. The tone parameters include key ON information and key OFF information of the keyboard 307, key ON/OFF information of the tone generation instruction switches 201, tone color information, effect information, and the like.

The D/A converter 311 converts the tone signal from a digital signal to an analog signal, and outputs the analog signal to an amplifier 312. The amplifier 312 amplifies the tone signal, and outputs it to a loudspeaker 313. The loudspeaker produces a tone.

The ROM 302 includes a waveform memory that stores a plurality of tone waveforms (tone color data), and stores the first or second tone generation mode for each of the plurality of tone waveforms. The tone generator 310 executes a tone generation process and mute process on the basis of the tone waveform stored in the waveform memory. The RAM 303 stores information of the tone generation mode copied from the ROM 302, and the user can change the copied tone generation mode. Details of such process will be described later with reference to FIG. 7.

The ROM 302 also stores a computer program. The CPU 301 executes processes shown in FIGS. 4 to 6 and the like (to be described later) in accordance with that computer program. The RAM 303 has a work area and the like of the CPU 301.

FIG. 7 shows the structure of tone color data stored in the ROM 302. Each tone color data includes a release time 704, attack time 705, decay time 706, vibrato rate 707, vibrato depth 708, vibrato decay 709, and the like in addition to a tone color number 701, velocity 702, toggle flag 703.

The tone color number 701 is assigned to each of the applause switch 202, wave switch 203, bell switch 204, roll cymbal switch 205, and the like in FIG. 2. The velocity 702 will be explained below. When a touch sensor is provided to each tone generation instruction switch 201 (FIG. 2), it detects the velocity or strength upon pressing the tone generation instruction switch 201 to set it as a velocity value. The tone volume is determined according to that velocity. If the tone generation instruction switch 201 is pressed strongly, a tone is generated with a large volume. If the touch sensor function is turned off (touch OFF) or when no touch sensor is provided to each tone generation instruction switch 201, a tone generation process is executed on the basis of the velocity 702 in FIG. 7.

The toggle flag 703=0 indicates the first tone generation mode, and the toggle flag 703=1 indicates the second tone generation mode. The value of the toggle flag 703 can be changed by user's operation, and the tone generation mode of each tone color number 701 can be set according to user's favor.

Figure 4:
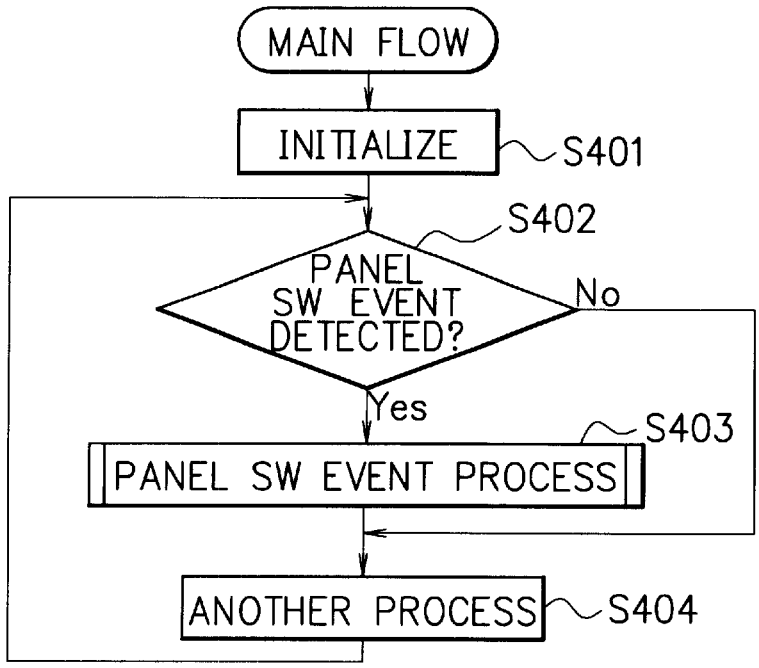
FIG. 4 is a flow chart showing the main flow of the process of the electronic musical instrument.

FIG. 4 is a flow chart showing the main flow of the process executed by the electronic musical instrument. When the power switch of the electronic musical instrument is turned on, the following process is done. In step S401, an initialize process is executed. It is checked in step S402 if a panel switch event upon operation of each panel switch is detected. If YES in step S402, the flow advances to step S403; otherwise, the flow jumps to step S404.

In step S403, a panel switch event process is executed, and the flow advances to step S404. Details of the panel switch event process will be described later with reference to the flow chart of FIG. 5. In step S404, other processes such as a tone generation process, keyboard event process, MIDI process, automatic performance process, display process, and the like are executed. After that, the flow returns to step S402 to repeat the above process.

Figure 5:
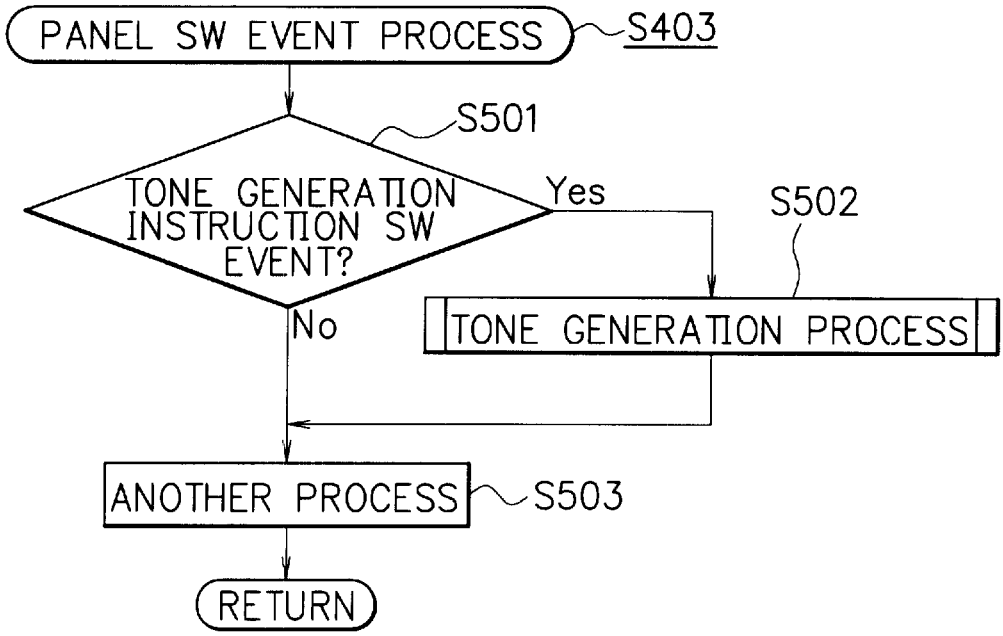
FIG. 5 is a flow chart showing a panel switch event process.

FIG. 5 is a flow chart showing the panel switch event process in step S403 in FIG. 4. It is checked in step S501 if an event is detected upon operation of each tone generation instruction switch 201 in FIG. 2. If YES in step S501, the flow advances to step S502; otherwise, the flow advances to step S503.

In step S502, a tone generation process is executed in accordance with the operated tone generation instruction switch, and the flow then advances to step S503. Details of this tone generation process will be described with reference to a flow chart shown in FIG. 6. In step S503, another panel switch event process is executed, and the processing ends.

Figure 6:
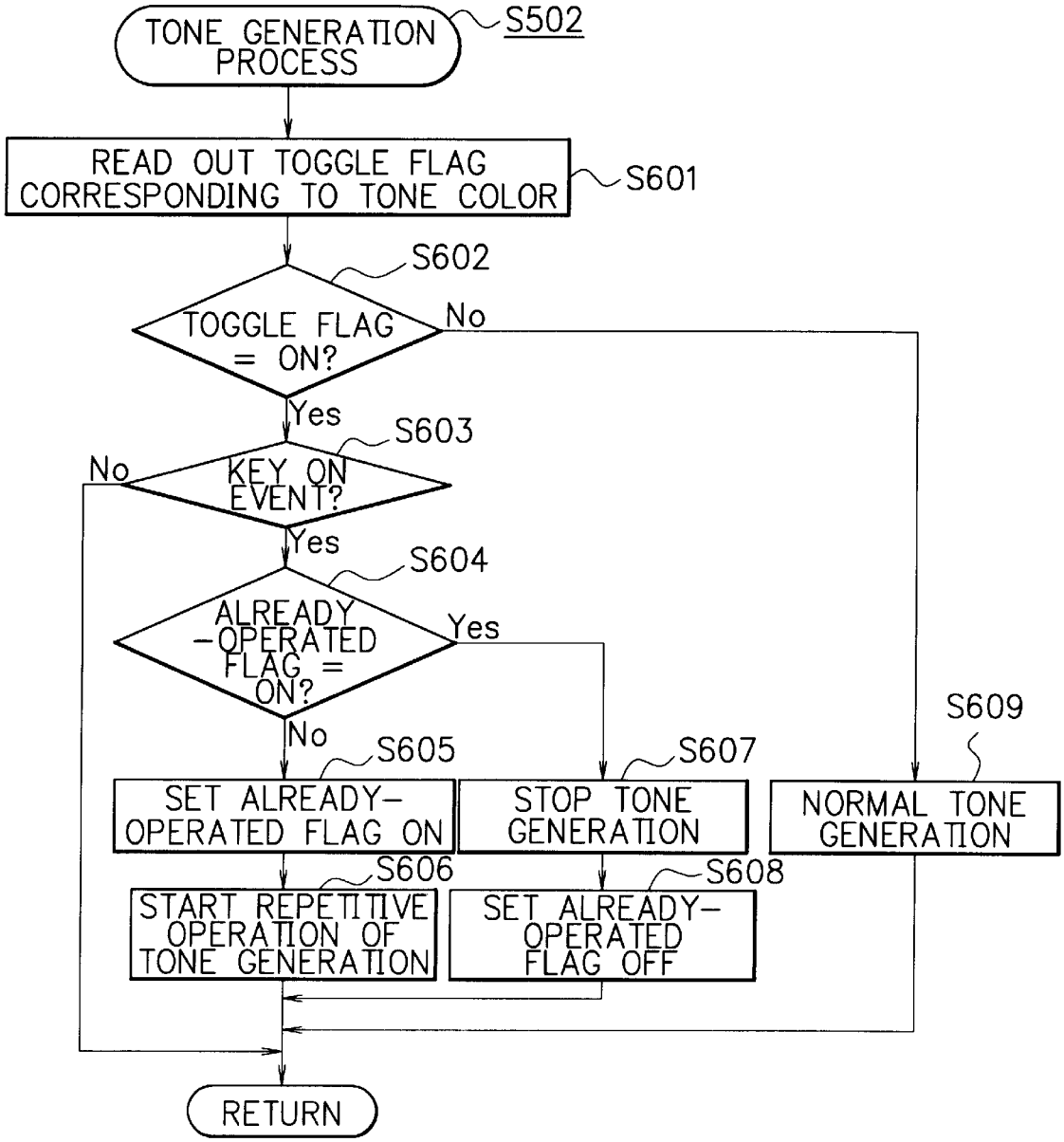
FIG. 6 is a flow chart showing a tone generation process.

FIG. 6 is a flow chart showing the tone generation process in step S502 in FIG. 5. In step S601, a toggle flag 703 corresponding to the tone color of the detected tone generation instruction switch event is read out on the basis of the tone color data shown in FIG. 7.

It is checked in step S602 if the toggle flag is ON ("1"). If the toggle flag is OFF ("0"), since it means the first tone generation mode, the flow advances to step S609. If the toggle flag is ON ("1"), since it means the second tone generation mode, the flow advances to step S603.

It is checked in step S603 if the detected tone generation instruction switch event is a key ON event. If YES in step S603, the flow advances to step S604; otherwise, the control returns to the process shown in FIG. 5.

It is checked in step S604 if an already-operated flag is ON. If the already-operated flag is OFF, the flow advances to step S605; otherwise, the flow advances to step S607. Since the already-operated flag is OFF in a default state, the flow advances to step S605 in the first process.

In step S605, the already-operated flag is set ON. In step S606, a tone generation process starts to repeat tone generation. That is, as shown in FIG. 8D, when the tone generation instruction switch signal 807 changes to key ON level KON1, a tone generation process starts, and the tone signal 808 forms attack A, decay D, and sustain S. After that, the processing ends, and the control returns to the process shown in FIG. 5.

Subsequently, when the tone generation instruction switch 201 of interest is released, a key OFF event is detected in step S603 via steps S601 and S602, and the control returns to the process shown in FIG. 5 without any process. That is, in FIG. 8D, even when the signal 807 changes to key OFF level KOFF1, no mute process is executed, but the tone generation process continues.

When the tone generation instruction switch 201 of interest is pressed again, it is determined in step S604 via steps S601 to S603 that the already-operated flag is ON, and the flow advance to step S607.

In step S607, a mute process for stopping tone generation is executed. In step S608, the already-operated flag is set OFF, and the control returns to the process shown in FIG. 5. That is, in FIG. 8D, when the signal 807 changes to key ON level KON2, the tone signal 808 forms release R, and is muted.

When the tone generation instruction switch 201 of interest is released, a key OFF event is detected in step S603 via steps S601 and S602, and the control returns to the process shown in FIG. 5 without any process. That is, in FIG. 8D, even when the signal 807 changes to key OFF level KOFF1, it does not influence the tone signal 808.

A case of the first tone generation mode will be described below. In the first tone generation mode, it is determined in step S602 that the toggle flag is OFF, and the flow advances to step S609. In step S609, a normal tone generation process shown in FIGS. 8A to 8C is executed. That is, a tone generation process starts upon detection of a key ON event, and a mute process is executed upon detection of a key OFF event. After that, the control returns to the process shown in FIG. 5.

When tone generation is repeated, for example, when a bell tone is repetitively generated, a plurality of (for example, three) "jingle" tones having different pitches (jingle A, jingle B, jingle C) are generated in succession like "jingle A-jingle B-jingle C". In this case, these bell tones may be generated in succession in a regular order A-B-C. However, if these tones are generated in a regular order, since they sound mechanically and unnaturally, these tones may be randomly generated like A-B-C-B-A-C-C-B-A. In place of preparing "jingle" data having different pitches, single "jingle" data may be prepared, and its pitch may be changed every time a tone is generated. In this case, the memory can be saved.

This embodiment has the first and second tone generation modes. The tone waveforms in the waveform memory include those suitable for the first tone generation mode, and those suitable for the second tone generation mode, and the tone waveforms are associated with the tone generation instruction switches.

In the first tone generation mode, a decay tone starts and ends tone generation by a single operation of the tone generation instruction switch, and a sustaining tone stops tone generation when the tone generation instruction switch is released. In case of applause, if a sequence assigned to a single operation comes to an end, tone generation stops. In the second tone generation mode, tone generation starts in response to operation of the tone generation instruction switch and continues even after the switch is released, and stops in response to the next operation.

The tone generation instruction switches may be replaced by various tone generation instruction operation members. The tone generation instruction operation members may include panel operation members or a keyboard including a plurality of black and white keys, or may be various other members such as a foot switch, touch bar, knee lever, and the like, as long as they can instruct tone generation.

Toggle flags are assigned to respective tone color numbers, and if the toggle flag is OFF, it indicates the first tone generation mode; if the toggle flag is ON, it indicates the second tone generation mode. Upon delivery from a factory, appropriate tone generation modes are set for respective tone colors and sequences, and the user can arbitrarily change them.

If the tone generation modes are assigned to respective tone color numbers in place of assigning the tone generation modes to respective tone generation instruction operation members, even when the user freely assigns tone colors and sequences to respective tone generation instruction operation members, a given tone generation mode can always correspond to a given tone color.

As described above, when appropriate tone generation modes are set for respective tone color numbers, a tone duration (tone generation time) required in each different performance can be obtained, thus broadening the performance expression range. For example, bell tones can be kept generated ad lib from a desired start position upon playing a Christmas song, and tone generation of these bell tones can be stopped at a desired end position.

The scope of the present invention includes a case wherein a software program code that implements the functions of this embodiment is supplied to an electronic musical instrument, and a computer (CPU or MPU) of that electronic musical instrument operates in accordance with the stored program.

In this case, the software program code itself implements the functions of the above-mentioned embodiment, the program code itself and means for supplying the program code to the computer (e.g., a recording medium that stores the program code) constitutes the present invention. As the recording medium that stores the program code, for example, a floppy disk, hard disk, optical disk, magneto-optical disk, CD-ROM, magnetic tape, nonvolatile memory card, ROM, and the like may be used.

Note that the above embodiment is merely an example upon practicing the present invention, and the technical scope of the present invention must not be limitedly interpreted by this embodiment. That is, the present invention can be practiced in various forms without departing from its technical idea or principal features.

As described above, since a tone generation process is executed during a period from when a given tone generation instruction operation member is operated until it is operated again, a desired tone duration can be obtained. Also, since the tone generation process can continue even when the tone generation instruction operation member is released after its operation, the player can freely use his or her hands and feet. For example, the player can make bimanual performance in a treble range while sustaining tone generation of only one tone in a bass range.

What is claimed is:

1. An electronic musical instrument comprising:

a tone generation instruction operation member for instructing to start tone generation;

a tone generation mode storage unit for storing tone generation modes; and a tone generation control unit for, when the tone generation mode is a first mode, starting a tone generation process upon operation of the tone generation instruction operation member and executing a mute process upon release of the tone generation instruction operation member, and for, when the tone generation mode is a second mode, starting a tone generation process upon operation of the tone generation instruction operation member, continuing the tone generation process even after the tone generation instruction operation member is released, and executing a mute process when the identical tone generation instruction operation member is operated again.

2. The instrument according to claim 1, further comprising:

a tone color data storage unit for storing a plurality of tone color data, and wherein the tone generation mode storage unit stores the tone generation modes in correspondence with the plurality of tone color data stored in the tone color data storage unit, and the tone generation control unit executes the tone generation process and mute process on the basis of the tone color data stored in the tone color data storage unit.

3. The instrument according to claim 2, wherein the tone generation modes stored in the tone generation mode storage unit can be changed.

4. The instrument according to claim 1, further comprising an all-sound OFF switch for, when tone generation processes of a plurality of tones in the second mode continue simultaneously, stopping these tone generation processes at the same time.

5. The instrument according to claim 1, further comprising a fade-out switch for, when tone generation processes of a plurality of tones in the second mode continue simultaneously, fading out these tone generation processes at the same time.

6. The instrument according to claim 1, wherein the tone generation instruction operation member is a panel operation member.

7. The instrument according to claim 1, wherein the tone generation instruction operation member is a keyboard including a plurality of black and white keys.

* * * * *